United States Patent [19]

Satake et al.

[11] Patent Number: 4,868,151

[45] Date of Patent: Sep. 19, 1989

[54] HEAT-SENSITIVE RECORDING MATERIAL

[75] Inventors: Toshimi Satake; Toshiaki Minami; Tomoaki Nagai; Fumio Fujimura, all of Tokyo, Japan

[73] Assignee: Jujo Paper Co., Ltd., Tokyo, Japan

[21] Appl. No.: 60,661

[22] Filed: Jun. 10, 1987

[30] Foreign Application Priority Data

Jun. 25, 1986 [JP] Japan ..... 61-149196

[51] Int. Cl.[4] ..... B41M 5/18

[52] U.S. Cl. ..... 503/209; 427/150; 427/151; 428/913; 428/914; 503/216; 503/217; 503/221

[58] Field of Search ..... 427/150–152; 503/216–218, 220, 221, 223, 225, 226, 200, 209; 428/913, 914

[56] References Cited

U.S. PATENT DOCUMENTS

| | | | |
|---|---|---|---|
| 4,591,888 | 5/1986 | Satake et al. | 427/151 |
| 4,658,276 | 4/1987 | Kanda et al. | 503/220 |

FOREIGN PATENT DOCUMENTS

| | | | |
|---|---|---|---|
| 0115255 | 9/1979 | Japan | 503/200 |
| 1172791 | 8/1986 | Japan | 503/217 |

*Primary Examiner*—Bruce H. Hess

*Attorney, Agent, or Firm*—Koda and Androlia

[57] ABSTRACT

A heat-sensitive recording material has a support and a color-developing layer which comprises a particular sulfone as an organic color-developing agent and a particular fluorene-type leuco dyestuff as a colorless basic chromogenic dyestuff. This heat-sensitive recording material is superior in light resistance, weather resistance, oil resistance and optical readability in the near infrared region.

7 Claims, No Drawings

HEAT-SENSITIVE RECORDING MATERIAL

BACKGROUND OF THE INVENTION

1. Field of the Invention

This invention relates to a heat-sensitive recording material which is superior in light resistance, weather resistance, oil resistance, and optical readability in the near infrared region.

2. Prior Art

In general, a heat-sensitive recording sheet is produced by applying a support, such as paper, synthetic paper, film, plastic, etc., the coating which is prepared by individually grinding and dispersing colorless chromogenic dyestuff and an organic color-developing agent, such as phenolic material, etc. into fine particles, mixing the resultant dispersion with each other and then adding thereto binder, filler, sensitizer, slipping agent and other auxiliaries. The coating, when heated by thermal per, thermal head, hot stamp, laser beam, etc., undergoes instantaneously a chemical reaction which forms a color. These heat-senstive recording sheets have now been finding a wide range of applications, including industrial measurement recording instruments, terminal printers of computer, facsimile equipments, automatic ticket vending machines, printer for bar-code-label, and so on. In recent years, as the applications of such recording is diversified and the performance of such recording equipment is enhanced, high qualities are required for heat-sensitive recording sheets. For example, even with small heat energy in a high speed recoding, both the clear image with a high density and the better preservability such as better resistance to light, weather and oil, etc. are required. These heat-sensitive recording sheets are also utilized as thermosensitive labels. Since, however, color formation in these recording sheets is in the visible region, they cannot be adapted for reading by a semiconductor laser in the near infrared region which is widely used as a bar code scanner in a POS system, etc.

On the other hand, Japanese Laid-Open Patent Publication Nos. 59-199757 and 60-226871 disclose a heat-sensitive recording sheet containing a combination of a conventional color developing agent (phenolic resin, hydroxybenzoate and bisphenol-A) a fluorene-type leuco dyestuff having excellent color-developing ability in the near infrared region.

However, these heat-sensitive recording sheets have a remarkably inferior stability (inferior resistance to light, weather and oils) of the recorded image. Hence, in long storage under condition of exposure to light, moisture, etc., the recorded image is discolored, the image density is reduced, and sometimes the image disappears, which deteriorates a optical readability in near infrared region. By the adhesion of serum, or by contact with plasticizer (DOP, DOA etc.) in wraping film, such as vinyl chloride film, the image density is prominently lowered or the recorded image disappears, which causes a remarkable reduction of a optical readability in the near infrared region. In view of above defects, the practical use of these heat-sensitive recording sheets was difficult.

SUMMARY OF THE INVENTION

It is the object of this invention to provide a heat-sensitive recording material which is superior in optical readability in the near infrared region.

It is the another object of this invention to provide a heat-sensitive recording material which is better in light resistance, weather resistance and oil resistance.

The above problems are solved as follows.

The heat-sensitive recording material of this invention is superior in optical readability in the near infrared region; better in light resistance, oil resistance, weather resistance (which provides a material having superior preservability); usable under severe conditions in bar-code-label, etc. heat-sensitive recording material is produced by using a support with a color-developing layer which contains as main ingredient a colorless or pale colored basic chromogenic dyestuff and an organic color-developing agent, said color-developing layer comprising as said organic color-developing agent at least one substance selected from the group consisting of 2,4,-dihydroxydiphenylsulfone and bis-(3-tert.-butyl-4-hydroxy-6-methylphenyl) sulfone and as said colorless basic chromogenic dyestuff 3,6,6'-tris-(dimethylamino)spiro[fluorene-9,3'-pthalide].

DETAILED DESCRIPTION OF THE INVENTION

Among the organic color-developing agent of this invention, 2,4'-dihydroxydiphenylsulfone (melting point of 181°-183° C.) are well known, while bis-(3-tert.-butyl-4-hydroxy-6-methylphenyl)sulfone is a new organic color-developing agent described in Japanese Laid-Open Patent Publication No. 61-230983 (Japanese Patent Application No. 60-73824). The above organic color-developing agents have following structural formulae:

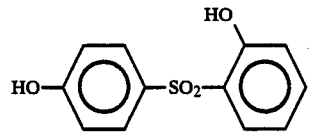

(2)

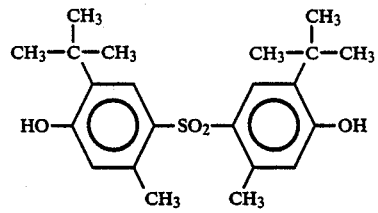

(3)

The above organic color-developing agents have a common molecular structure, in which two phenol rings are bound with sulfone group.

The effects of this invention considers to be produced by such structural features.

In the explanation of above general formulae (I) and (II), the term "lower" for defining alkyl group and alkoxy group, usually represents those groups containing from 1 to 5 carbon atoms. And alkyl group and alkoxy group may be linear or branched.

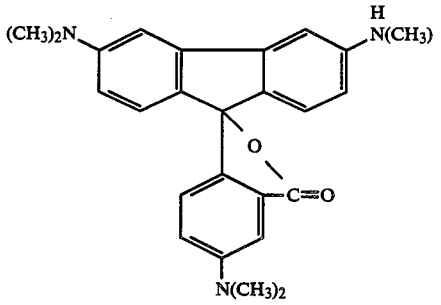

(XV)

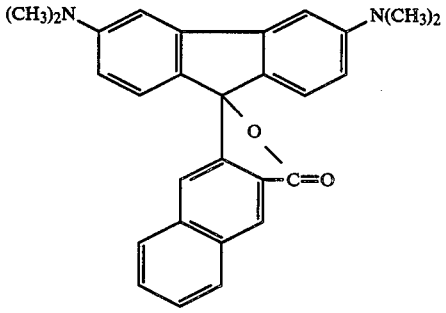

(XVI)

3,6,6'-tris-(dimethylamino)spiro[fluorene-9,3'-phthalide] (melting point of 244°–246° C.) having the following structural formula is most preferred, taking the productivity, costs and performances into consideration.

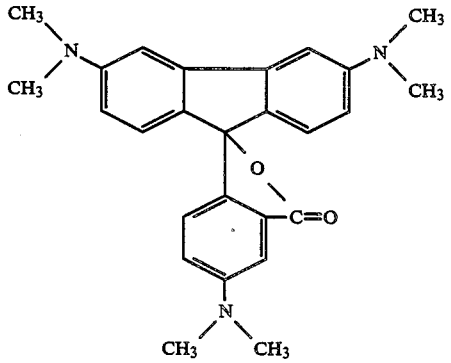

(VIII)

The fluorene-type leuco dyestuff of this invention may be used together with a black color forming fluoran dyestuff for the complement of a color-forming in visible region. The example for such black color forming fluoran dyestuff are described later.

3-diethylamino-6-methyl-7-anilinofluoran
3-(N-ethyl-p-toluidino)-6-methyl-7-anilinofluoran
3-(N-ethyl-N-isoamyl)amino-6-methyl-7-anilinofluoran
3-diethylamino-6-methyl-7-(o,p-dimethylanilino)fluoran
3-pyrolidino-6-methyl-7-anilinofluoran
3-pyperidino-6-methyl-7-anilinofluoran
3-(N-cyclohexyl-N-methylamino)-6-methyl-7-anilinofluoran
3-diethylamino-7-(m-trifluoromethylanilino)fluoran
3-diethylamino-6-chloro-7-anilinofluoran
3-dibutylamino-7-(o-chloroanilino)fluoran
3-diethylamino-7-(o-chloroanilino)fluoran As sensitizer, there may be used fatty acid amide such as stearic acid amide, palmitic acid amide; ethylenebisamide; montan wax; polyethylene wax; dibenzyl terephthalate; benzyl p-benzyloxybenzoate; di-p-tolyl carbonate; p-benzyl biphenyl; phenyl alphanaphthylcarbonate; 1,4-diethoxynaphthalene; 1-hydroxy-2-naphthoic acid phenyl ester; and the like.

The effects of the present invention may be improved by the addition of halogen-substituted zinc benzoate derivative as stabilizer. Examples of halogen-substituted zinc benzoate derivative are as follows.

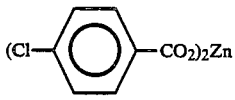

(1)

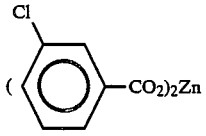

(2)

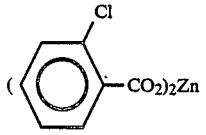

(3)

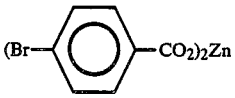

(4)

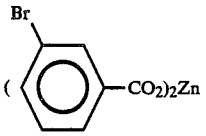

(5)

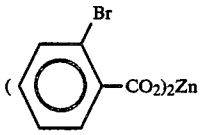

(6)

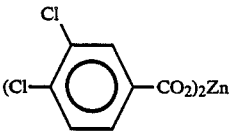

(7)

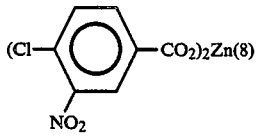

(8)

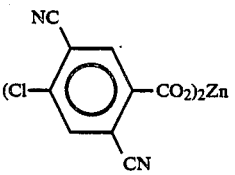

(9)

-continued (10)

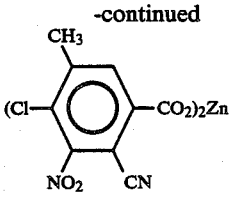

(11)

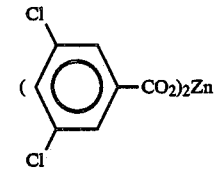

(12)

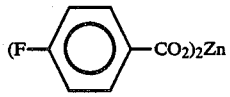

(13)

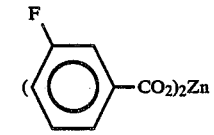

(14)

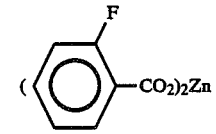

(15)

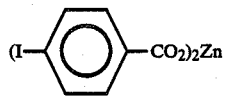

(16)

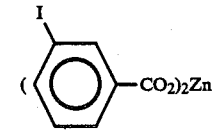

(17)

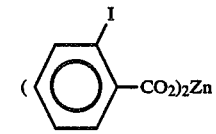

(18)

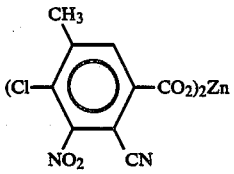

In order to prevent the damage by physical impact and avoid the peeling of the heat-sensitive color developing layer on the substrate by moisture, the front surface of the heat-sensitive layer and the back surface of the substrate may be laminated with thin transparent resin-film such as polyester, polypropylene, and the like.

As the binders of this invention, there can be mentioned, for example, a fully saponified polyvinyl alcohol having a polymerization degree of 200–1900, a partially saponified polyvinyl alcohol, carboxylated polyvinyl alcohol, amide-modified polyvinyl alcohol, sulfonic acid-modified polyvinyl alcohol, butyral-modified polyvinyl alcohol, other modified polyvinyl alcohol, hydroxyethyl cellulose, methyl cellulose, carboxymethyl cellulose, styrene/malic acid anhydride copolymers, styrene/butadiene copolymers, cellulose delivatives such as ethyl cellulose, acetyl cellulose, etc.; polyvinyl chloride, polyvinyl acetate, polyacryl amide, polyacrylic acid ester, polyvinyl butyral, polystyrol and copolymers thereof; polyamide resin, silicone resin, petroleum resin, terpene resin, ketone resin and cumaron resin.

These polymeric materials may be used after they were dissolved in a solvent such as water, alcohol, ketone, ester, hydrocarbon, etc., or after they were emulsified or dispersed in water or a solvent other than water.

The species and the amount of organic color-developing agent of this invention, basic colorless chromogenic dyestuff of this invention, and other ingredients are determined depending upon the performance and recording aptitude required for the heat-sensitive recording material, and are not otherwise limited. However, in ordinary cases, it is suitable to use 1–8 parts by weight of organic color-developing agent and 1–20 parts by weight of filler, based on 1 part by weight of basic colorless chromogenic dyestuff, and to add 10–25 parts by weight of a binder in 100 parts by weight of total solid content.

The aimed heat-sensitive recording material may be obtained by coating the above coating color on a support such as paper, synthetic paper, film, etc.

The above organic color-developing agent, the above basic colorless chromogenic dyestuff, if necessary other ingredients are ground down to a particle size of several microns or smaller by means of a grinder or emulsifier such as a ball mill, attritor, sand grinder, etc. and binder and various additives in accordance with the purpose, are added thereto to prepare coating colors. The additives of this invention are, for example, inorganic or organic fillers such as silica, calcium carbonate, kaolin, calcined kaolin, diatomaceous earth, talc, titanium dioxide, aluminium hydroxide; releasing agent such as metal satls of fatty acids, etc.; slipping agent such as waxes, etc.; UV-absorbers such as benzophenone type or triazole type; water-resistance agent such as glyoxal, etc.; dispersant; anti-foamer; etc.

(Function)

The reason why a heat-sensitive recording material of the present invention is superior in the optical readability in the near infrared region is explained as follows. The conventional recorded image of a recording material using electron donor-color forming agent, such as fluoran-type leuco dyestuff, etc., does not absorb the light in near infrared region. However, a particular fluorane-type leuco dyestuff absorbs the light of the near infrared region (specifically the near infrared region of 700–1000 nm) effectively, when it is colored through heat-melt-reaction with electron-accepting agent (color-developing agent).

The reason why the recorded image of a heat-sensitive recording material of the present invention is stable in light-resistance, weather-resistance and oil resistance is explained as follows. Generally, a heat-sensitive recording material is composed of basic colorless dyestuff as electron donor and of organic acidic material, such as phenolic material, aromatic carboxylic acid, organic sulfonic acid etc. as electron-acceptor. The heat-melt reaction between a basic colorless dyestuff and a color-developing agent is an acid-base reaction based on donating-acceptance of electron, whereby pseudo-stable "electron charge transmitting complex" is produced, which forms color.

However, 2,4'-dihydroxydiphenylsulfone and bis-(3-tert.-butyl-4-hydroxy-6-methylphenyl)sulfone of the present invention have a structure consisting of two phenol rings bound with sulfone group.

In color-forming process of these sulfone compound as an organic color-developing agent, the chemical binding force between a particular fluoren-type colorless basic dyestuff and each of 2,4'-dihydroxydiphenylsulfone and bis-(3-tert.-butyl-4-hydroxy-6-methylphenyl)sulfone is much stronger than that between a fluorene-type colorless basic dyestuff and a conventional color-developing agent (e.g. acid clay, phenolic resin, hydroxy benzoic acid ester, bisphenol A and p-hydroxy benzoic acid benzyl ester), and hence it seems that the chemical bondings do not deteriorate for a long period even under the circumstance of light heat, humidity etc., so that a recorded image is remarkably stable, which does not lower the optical readability of the recorded image in the near infrared region

(EXAMPLES)

The following examples illustrate this invention, although the invention is not limited to examples. The part are parts by weight.

[EXAMPLE 1]

| Solution A (dispersion of dyestuff) | |
|---|---|
| 3,6,6'-tris (dimethylamino)spriro [fluorene-9,3'-phthalide] | 2.0 parts |
| 10% aqueous solution of polyvinyl alcohol | 4.6 parts |
| Water | 2.6 parts |
| **Solution B (dispersion of color-developing agent)** | |
| 2,4'-dihydroxydiphenyl sulfone | 6.0 parts |
| 10% aqueous solution of polyvinyl alcohol | 18.8 parts |
| Water | 11.2 parts |

The solutions A and B of the above-mentioned composition were individually ground to a particle size of 3 microns by attritor. Then, the dispersions were mixed in the following portion to prepare the coating color.

| Coating Color | |
|---|---|
| Solution A | 9.2 parts |
| Solution B | 36.0 parts |
| Kaolin clay (50% aqueous dispersion) | 12.0 parts |

The coating color was applied on one side of a base paper weighing 50 g/m$^2$ at a coating weight of 6.0 g/m$^2$ and was then dried. The resultant paper was treated to a smoothness of 200–600 seconds by a supercalender. In this manner a heat-sensitive recording paper was obtained.

[EXAMPLE 2]

| Solution C (dispersion of sensitizer) | |
|---|---|
| p-benzylbiphenyl | 4.0 parts |
| 10% aqueous solution of polyvinyl alcohol | 12.5 parts |

-continued

| Solution C (dispersion of sensitizer) | |
|---|---|
| Water | 7.5 parts |

The solution C of the above-mentioned composition was ground to a particle size of 3 microns by attritor. Then, the dispersions were mixed in the following portion to prepare the coating color.

| Coating Color | |
|---|---|
| Solution A (dispersion of dyestuff) | 9.2 parts |
| Solution B (dispersion of color developing agent) | 36.0 parts |
| Solution C (dispersion of sensitizer) | 24.0 parts |
| Kaolin clay (50% aqueous dispersion) | 12.0 parts |

A heat-sensitive recording sheet was obtained in the same manner as in Example 1.

[EXAMPLE 3]

| Solution D (dispersion of stabilizer) | |
|---|---|
| Zinc p-chlorobenzoate | 4.0 parts |
| 10% aqueous solution of polyvinyl alcohol | 12.5 parts |
| Water | 7.5 parts |

The solution D was ground and dispersed. A heat-sensitive recording sheet was obtained in the same manner as in Example 2 except using Solution D instead of Solution C.

[COMPARATIVE EXAMPLE 1]

| Solution A (dispersion of dyestuff) | |
|---|---|
| 3,6,6'-tris.-(dimethylamino)spiro [fluorene-9,3'-phthalide] | 2.0 parts |
| 10% aqueous solution of polyvinyl alcohol | 4.6 parts |
| Water | 2.6 parts |
| **Solution H (dispersion of color-developing agent)** | |
| Color-developing agent (see Table 1) | 6.0 parts |
| 10% aqueous solution of polyvinyl alcohol | 18.8 parts |
| Water | 11.2 parts |

The solutions A and H of the above-mentioned composition were individually ground to a particle size of 3 microns by attritor. Then, the dispersions were mixed in the following portion to prepare the coating color.

| Coating Color | |
|---|---|
| Solution A (dispersion of dyestuff) | 9.2 parts |
| Solution H (dispersion of color-developing agent) | 36.0 parts |
| Kaolin clay (50% aqueous dispersion) | 12.0 parts |

The coating color was applied on one side of a base paper weighing 50 g/m$^2$ at a coating weight of 6.0 g/m$^2$ and was dried. The resultant paper was treated to a smoothness of 200–600 seconds by a supercalender. In this manner, heat-sensitive recording sheets were obtained. With regard to the heat-sensitive recording sheets of Examples 1–6 and Comparative Example 1, the test results are shown in Tables 1 and 2.

TABLE 1

Test Results

| | Test No. | Color developing agent | Basic colorless chromogenic dyestuff | Sensitizer or stabilizer | Image density Static (1) | Image density Dynamic (2) | Infrared reflectance (%) (3) |
|---|---|---|---|---|---|---|---|
| Example 1 | 1 | 2,4'-Dihydroxydiphenyl sulfone | 3,6,6'-Tris (dimethyl-amino)-spiro[fluorene-9,3'-phthalide] | — | 1.43 | 1.04 | 2 |
| Example 2 | 2 | 2,4'-Dihydroxydiphenyl sulfone | 3,6,6'-Tris(dimethyl-amino)-spiro[fluorene-9,3'-phthalide] | p-Benzyl-biphenyl | 1.49 | 1.18 | 2 |
| Example 3 | 3 | 2,4'-Dihydroxydiphenyl sulfone | 3,6,6'-Tris(dimethyl-amino)-spiro[fluorene-9,3'-phthalide] | Zinc p-chloro-benzoate | 1.49 | 1.12 | 2 |
| Example 4 | 4 | Bis-(3-tert.-butyl-4-hydroxy-6-methyl-phenyl) sulfone | 3,6'-Bis(diethyl-amino)-fluorenespiro-(9,3') phthalide | — | 1.33 | 0.94 | 3 |
| Example 5 | 5 | Bis-(3-tert.-butyl-4-hydroxy-6-methyl-phenyl) sulfone | 3,6'-Bis(diethyl-amino)-fluorenespiro-(9,3') phthalide | p-Benzyl-biphenyl | 1.35 | 1.06 | 3 |
| | Test No. | Color developing agent | Basic color chromogenic dyestuff | Sensitizer or stabilizer | Image density Static (1) | Image density Dynamic (2) | Infrared reflectance (%) (3) |
| Example 6 | 6 | Bis-(3-tert.-butyl-4-hydroxy-6-methyl-phenyl) sulfone | 3,6'-Bis(diethyl-amino)-fluorenespiro-(9,3') phthalide | Zinc p-chloro-benzoate | 1.35 | 1.01 | 3 |
| Comparative Example 1 | 7 | 4,4'-Isopropylidene-diphenol | 3,6,6'-Tris(dimethyl-amino)-spiro[fluorene-9,3'-phthalide] | — | 1.01 | 1.00 | 11 |
| | 8 | 4,4'-Hydroxybenzoic-acid benzyl ester | 3,6,6'-Tris(dimethyl-amino)-spiro[fluorene-9,3'-phthalide] | — | 1.0 | 0.72 | 28 |

TABLE 2

Test results

| | Test No. | Light resistance (4) Before oil treatment | Light resistance (4) After oil treatment | Light resistance (4) Percent residue (%) | Light resistance (4) Infrared reflectance (%) | Oil resistance (5) Before oil treatment | Oil resistance (5) After oil treatment | Oil resistance (5) Percent residue (%) | Oil resistance (5) Infrared reflectance (%) | Weather resistance (6) Before treatment | Weather resistance (6) After treatment | Weather resistance (6) Percent residue (%) | Weather resistance (6) Infrared reflectance (%) |
|---|---|---|---|---|---|---|---|---|---|---|---|---|---|
| Example 1 | 1 | 1.04 | 1.00 | 96 | 8 | 1.04 | 0.75 | 72 | 16 | 1.04 | 1.03 | 99 | 7 |
| Example 2 | 2 | 1.18 | 1.14 | 97 | 6 | 1.18 | 0.83 | 70 | 12 | 1.18 | 1.18 | 100 | 6 |
| Example 3 | 3 | 1.12 | 1.11 | 99 | 5 | 1.12 | 1.07 | 96 | 7 | 1.12 | 1.11 | 99 | 5 |
| Example 4 | 4 | 0.94 | 0.93 | 99 | 9 | 0.94 | 0.71 | 76 | 18 | 0.94 | 0.94 | 100 | 8 |
| Example 5 | 5 | 1.06 | 1.05 | 99 | 7 | 1.06 | 0.78 | 74 | 14 | 1.06 | 1.06 | 100 | 6 |
| Example 6 | 6 | 1.01 | 0.99 | 98 | 5 | 1.01 | 0.97 | 96 | 8 | 1.01 | 1.01 | 100 | 6 |
| Comparative Example 1 | 7 | 1.00 | 0.65 | 65 | 35 | 1.00 | 0.07 | 7 | 95 | 1.00 | 0.69 | 69 | 25 |
| | 8 | 0.72 | 0.48 | 67 | 76 | 0.72 | 0.06 | 8 | 96 | 0.72 | 0.15 | 21 | 89 |

NOTES

(1) Static image density

A heat-sensitive recording sheet is pressed down for 5 seconds under pressure of 10 kg/cm$^2$ on a hot plate heated at 105° C., and the optical density is measured by a Macbeth densitometer (RD-514. using amber filter which is used in other samples).

(2) Dynamic image density

A heat-sensitive recording sheet is recorded with an impressed voltage of 18.03 Volt and a pulse width of 3.2 milli-seconds and the optical density of the recorded image is measured by a Macbeth-densitometer.

(3) Reflectance of infrared ray

The recorded image printed in Note (2) is measured by a spectrophotometer (using a wave length of 800 nm).

(4) Light resistance

The recorded image printed in Note (2) is defined as image density before oil treatment. The recorded image is subjected to irradiation by light for 2 hours using a fade-O-meter, and then the image density (after oil treatment) is measured. Residual rate is calculated from the following equation.

$$\text{Residual rate} = \frac{\text{Image density after oil treatment}}{\text{Image density before oil treatment}} \times 100$$

And the reflectance of infrared red ray is measured with respect to the recorded image after light irradiation.

(5) Oil resistance

The recorded image printed in Note (2) is defined as image density before oil treatment. A drop of castor oil is applied on the recorded image, and wished off with filter paper after 10 sec. The obtained paper allows to stand for 24 hours at room temperature, and image density after oil treatment is measured. Residual rate is calculated from the following equation.

$$\text{Residual rate} = \frac{\text{Image density after oil treatment}}{\text{Image density before oil treatment}} \times 100\ (\%)$$

And the reflectance of infrared ray is measured with respect to the recorded image after oil treatment.

(6) Weather resistance

The recorded image printed in Note (2) is defined as image density before treatment. The recorded image allows to stand for a week under the conditions of 25° C. and 50% RH, and then the image density is measured by Macbeth densitometer.

$$\text{Residual rate} = \frac{\text{Image density after treatment}}{\text{Image density before treatment}} \times 100\ (\%)$$

And the reflectance of infrared ray is measured by spectrophotometer (using a wave length of 800 nm) with respect to the recorded image after treatment.

This heat-sensitive recording material of this invention exhibits following effects.

(1) superior optical readability in the near infrared region, (2) better in light resistance, oil resistance, weather resistance, which provides a material with superior preservability.

(3) useable under severe conditions in bar-code-label, etc., owing to the above effect.

We claim:

1. A heat-sensitive recording material comprising a support having thereon a color-developing layer which contains as its ingredient a colorless or pale colored basic chromogenic dyestuff and an organic color-developing agent, said color-developing layer comprising as said organic color-developing agent at least one substance selected from the group consisting of 2,4'-dihydroxydiphenylsulfone and bis-(3-tert.-butyl-4-hydroxy-6-methylphenyl)sulfone and as said colorless basic chromogenic dyestuff 3,6,6'-tris-(dimethylamino)-spiro[fluorene-9,3'-phthalide].

2. The heat-snsitive recording material according to claim 1, wherein said color-developing layer comprises said fluorene-type leuco dyestuff and further a black color forming fluoran dyestuff.

3. The heat-sensitive recording material according to claim 1, wherein said color-developing layer comprises further a halogen-sustituted zinc benzoate derivative.

4. The heat-sensitive recording material according to claim 1, wherein said color-developing layer comprises 1–8 parts by weight of organic color-developing agent and 1–20 parts by weight of filler, based on 1 part by weight of basic colorless chromogenic dyestuff, and 10–25 parts by weight of binder in 100 parts by weight of total solid content.

5. The heat-sensitive recording material according to claim 1, wherein said support is at least one member selected from a group consisting of paper, synthetic paper and film.

6. The heat-sensitive recording material according to claim 1, wherein the back surface of said substrate is laminated with a thin transparent resin film.

7. The heat-sensitive recording material according to claim 6, wherein said resin film is at least one member selected from a group consisting of polyester and polypropylene.

* * * * *